US010473055B2

(12) United States Patent
Mikami

(10) Patent No.: US 10,473,055 B2
(45) Date of Patent: Nov. 12, 2019

(54) FUEL INJECTION CONTROL DEVICE

(71) Applicant: DENSO CORPORATION, Kariya, Aichi-pref. (JP)

(72) Inventor: Naoki Mikami, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/133,831

(22) Filed: Sep. 18, 2018

(65) Prior Publication Data

US 2019/0093590 A1 Mar. 28, 2019

(30) Foreign Application Priority Data

Sep. 28, 2017 (JP) ..... 2017-189174

(51) Int. Cl.
*F02D 41/38* (2006.01)

(52) U.S. Cl.
CPC .. *F02D 41/3809* (2013.01); *F02D 2200/0602* (2013.01); *F02D 2200/0618* (2013.01)

(58) Field of Classification Search
CPC ..... F02D 41/38; F02D 41/3809; F02D 2200/0602; F02D 2200/0618
See application file for complete search history.

(56) References Cited

U.S. PATENT DOCUMENTS 7,370,638 B2 * 5/2008 Hayakawa ..... F02D 41/221 123/467
7,891,342 B2 * 2/2011 Dintino ..... F02D 41/3863 123/300
2017/0074200 A1 3/2017 Yamada et al.

FOREIGN PATENT DOCUMENTS

DE 10-2014-210561 12/2015
JP 2016-196893 11/2016

* cited by examiner

*Primary Examiner* — Hieu T Vo
(74) *Attorney, Agent, or Firm* — Nixon & Vanderhye P.C.

(57) ABSTRACT

A fuel injection system is provided with a pressure accumulator accumulating a high pressure fuel, a fuel pump supplying the high pressure fuel to the pressure accumulator, a fuel injector injecting the high pressure fuel, and a fuel pressure sensor detecting a fuel pressure in a fuel passage between the pressure accumulator and an injection port of the fuel injector. An ECU includes a fuel pressure obtaining portion which obtains the fuel pressure detected by the fuel pressure sensor, a differential value calculating portion which differentiates the fuel pressure obtained by the fuel pressure obtaining portion so as to calculate a fuel pressure differential value, and an end timing calculating portion which calculates an injection end timing at which the fuel injector terminates a fuel injection.

9 Claims, 8 Drawing Sheets

FUEL INJECTION CONTROL DEVICE

CROSS REFERENCE TO RELATED APPLICATION

This application is based on Japanese Patent Application No. 2017-189174 filed on Sep. 28, 2017, the disclosure of which is incorporated herein by reference.

TECHNICAL FIELD

The present disclosure relates to a fuel injection control device which injects high pressure fuel stored in a common rail.

BACKGROUND

In a fuel injection system in which fuel is supplied from a common rail (pressure accumulator) to a fuel injector, when the fuel injector injects the fuel, a fuel pressure in the fuel injector varies according to an injection rate variation. A fuel pressure sensor detects a variation waveform of the fuel pressure when the fuel is injected. Based on a detected variation waveform of the fuel pressure, a waveform indicating the injection rate variation is estimated.

JP 2017-53309 A shows that a moving average of fuel pressure differential values is calculated and a fuel pressure characteristic is analyzed based on a fuel pressure waveform of the fuel pressure identified by the moving average. Specifically, a maximum value and a minimum value of the moving average are detected, and an approximate straight line is calculated by least squares method. Intersections of the approximate straight line and a reference straight line are defined as an injection start timing and an injection end timing.

It has been confirmed that a water hammer wave (pressure wave) is generated due to a start of fuel injection, and such water hammer wave affects a detection of an injection end timing. According to the technique shown in JP 2017-53309 A, it is likely that an injection end timing may be erroneously detected.

Especially, in a common rail, it is conceivable that the influence of the water hammer wave depends on manufacturing tolerance. A fuel pipe is connected to the common rail through an orifice. An orifice diameter has a variation due to manufacturing tolerance. The variation in orifice diameter affects a fuel pressure variation which is generated due to the water hammer wave, so that an injection end timing may be erroneously detected.

SUMMARY

It is an object of the present disclosure to provide a fuel injection control device which is able to detect an injection end timing properly.

According to the present disclosure, a fuel injection control device is applied to a fuel injection system which includes a pressure accumulator accumulating a high pressure fuel, a fuel pump supplying the high pressure fuel to the pressure accumulator, a fuel injector injecting the high pressure fuel, and a fuel pressure sensor detecting a fuel pressure in a fuel passage between the pressure accumulator and an injection port of the fuel injector. The fuel injection control device includes a fuel pressure obtaining portion which obtains the fuel pressure detected by the fuel pressure sensor; a differential value calculating portion which differentiates the fuel pressure obtained by the fuel pressure obtaining portion so as to calculate a fuel pressure differential value; and an end timing calculating portion which calculates an injection end timing at which the fuel injector terminates a fuel injection.

When the fuel injection is terminated, a fuel outflow from an injection port is stopped. An inclination of a fuel pressure waveform is varied. A variation in inclination can be obtained based on a fuel pressure differential value. The injection end timing is calculated based on the fuel pressure differential value.

DETAILED DESCRIPTION

Figure 1:
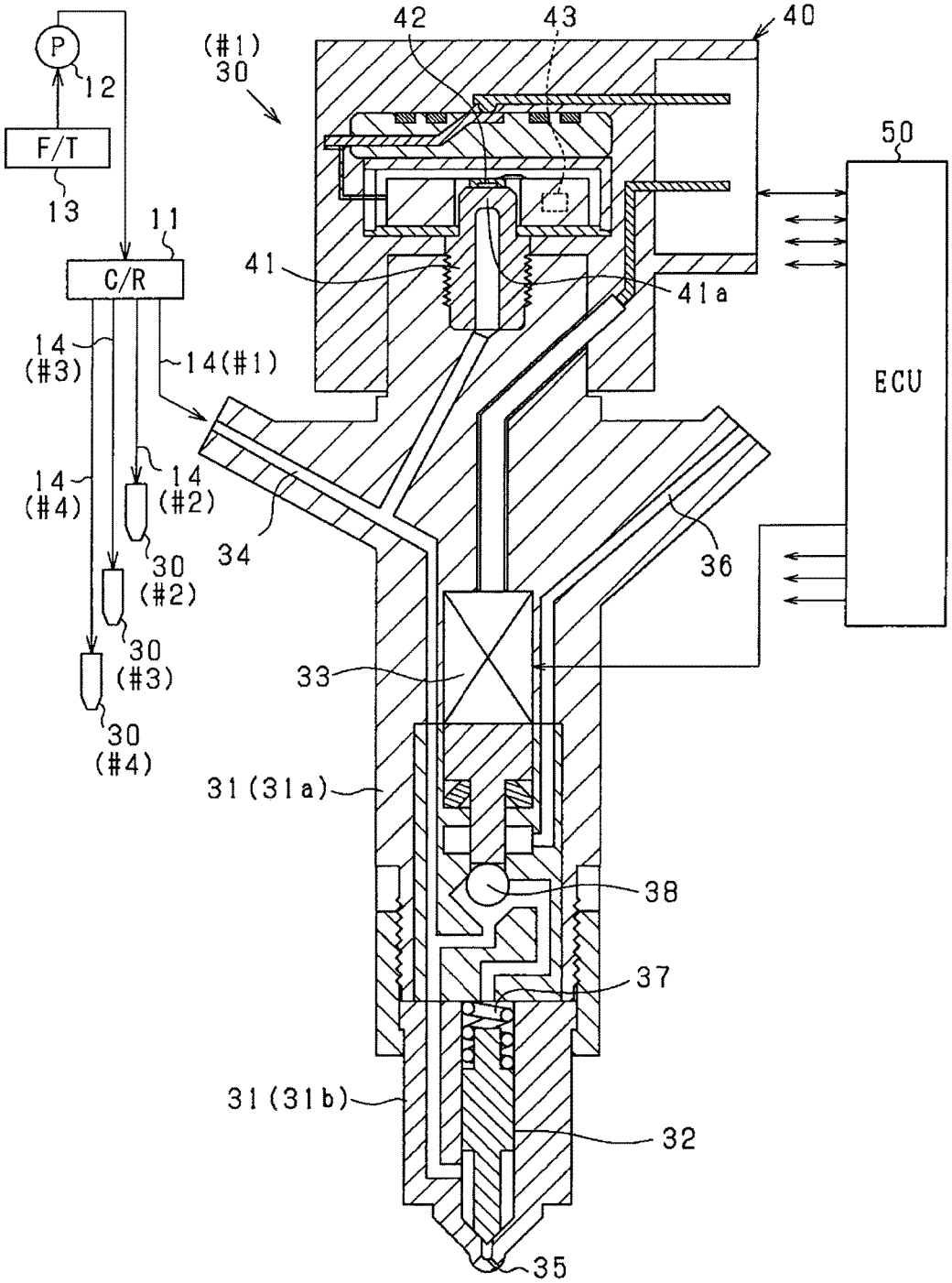
FIG. 1 is a chart showing an outline of a fuel injection system.

Referring to drawings, embodiments of a fuel injection control device will be described. FIG. 1 shows a configuration of a fuel injection system to which a fuel injection control device is applied. The fuel injection system is applied to a four-cylinder diesel engine (multi-cylinder internal combustion engine). The fuel injection system includes a common rail 11 (pressure accumulator) that accumulates high-pressure fuel, a fuel pump 12 that pressure-feeds the fuel to the common rail 11, and a fuel injector 30 provided to each cylinder #1 -#4, and a fuel pressure sensor 40 that detects a fuel pressure in a fuel passage.

A fuel tank 13 stores fuel which will be supplied to each cylinder #1 -#4 of the engine. The fuel in the fuel tank 13 is supplied to the common rail 11 by a fuel pump 12. The fuel pressure in the common rail 11 corresponds to a fuel supply pressure which is supplied to the fuel injector 30. The fuel in the common rail 11 is distributed to each fuel injector 30 through a high pressure pipe 14 (fuel passage).

Figure 2:
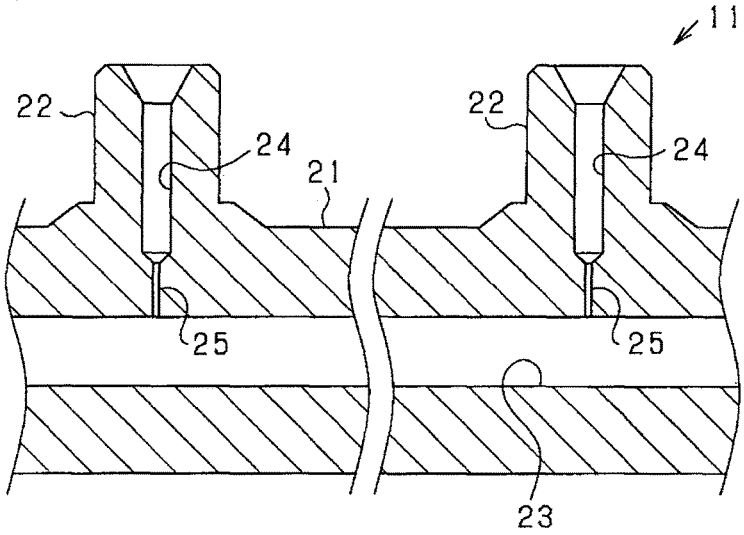
FIG. 2 is a cross-sectional view showing an internal structure of a common rail.

FIG. 2 shows an internal structure of the common rail 11. The common rail 11 has a tubular main body 21 and a plurality of pipe connecting portions 22. The tubular main body 21 defines an accumulator chamber 23. Each pipe connecting portion 22 defines a communicating hole 24 which communicates with the accumulator chamber 23. An orifice 25 is provided between the accumulator chamber 23 and the communicating hole 24. The high pressure pipe 14 is connected to each pipe connecting portion 22. The high pressure fuel in the accumulator chamber 23 flows into each high pressure pipe 14 through the orifice 25 and the communicating hole 24.

A configuration of the fuel injector 30 will be described, hereinafter. The fuel injector 30 is provided with a pressure sensor integrally.

The fuel injector 30 is provided with a body 31, a needle valve 32, and an actuator 33 including an electromagnetic coil, a piezo element and the like. The body 31 has a first portion 31a and a second portion 31b which are connected to each other. The body 31 defines a high pressure passage 34, an injection port 35, and a low pressure passage 36. The fuel supplied from the common rail 11 flows through the high pressure passage 34 toward the injection port 35. The needle valve 32 slides in the body 31 to open/close the injection port 35.

Further, the body 31 defines a back pressure chamber 37 which is branched from the high pressure passage 34. High pressure fuel is introduced into the back pressure chamber 37. A back pressure is applied to the needle valve 32 in the back pressure chamber 37. A control valve 38 is disposed between the back pressure chamber 37 and the low pressure passage 36. A communication between the high pressure side and the low pressure side is switched by the control valve 38.

Specifically, when the actuator 33 is de-energized, the high pressure side and the low pressure side are fluidly disconnected by the control valve 38. The needle valve 32 closes the injection port 35. That is, the needle valve 32 is positioned at a valve close position. When the actuator 33 is energized, the control valve 38 is pushed down so that the high pressure side and the low pressure side are communicated with each other. As a result, the fuel pressure in the back pressure chamber 37 decreases, and the needle valve 32 moves up to open the injection port 35. The high pressure fuel is injected from the injection port 35.

Each fuel injector 30 is provided with a fuel pressure sensor 40. The fuel pressure sensor 40 includes a stem 41 as a strain body, a pressure sensor element 42, and a communication circuit 43. The stem 41 is attached to the body 31 and has a diaphragm portion 41*a*. The diaphragm portion 41*a* is elastically deformed under the pressure of the high pressure fuel flowing through the high pressure passage 34. The pressure sensor element 42 is attached to the diaphragm portion 41*a* and outputs a pressure signal corresponding to the elastic deformation amount of the diaphragm portion 41*a*. Then, the pressure signal output from the pressure sensor element 42 is transmitted to the ECU 50 through the communication circuit 43.

The ECU 50 is configured by a microcomputer including a CPU, a ROM, a RAM, an I/O, and a bus line connecting them. The RAM is a data memory and the ROM is a program memory. The ECU 50 calculates a target injection state (number of injection stages, injection start timing, injection end timing, injection amount, etc.) based on an accelerator operation amount of the vehicle, an engine load, an engine speed and the like. The ECU 50 performs a fuel injection control based on the target injection state.

Specifically, the ECU 50 calculates the target injection state based on the current engine load and the current engine speed in view of an injection state map which defines an optimum injection state. Further, the ECU 50 calculates an actual injection state based on a fuel pressure Pf detected by the fuel pressure sensor 40. Based on the target injection state and the actual injection state, the ECU 50 sets an injection command signal. For example, a feedback control is performed so that the actual injection end timing agrees with the target injection end timing. The fuel injector 30 is driven according to the injection command signal.

Figure 3:
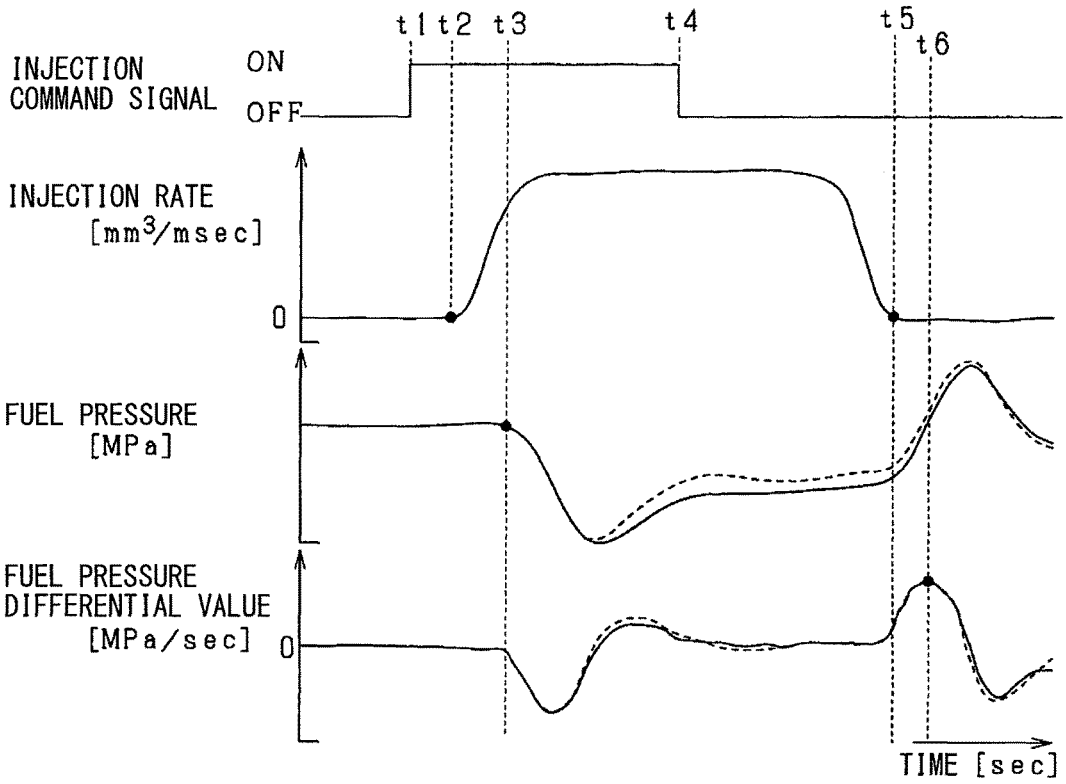
FIG. 3 is a time chart showing fuel pressure behaviors at a time of fuel injection by a fuel injector.

Referring to FIG. 3, a fuel pressure behavior will be described. FIG. 3 shows the injection command signal, the injection rate, the fuel pressure, and the fuel pressure differential value. The fuel pressure is detected by the fuel pressure sensor 40. The detected fuel pressure has a pressure propagation delay with respect to the variation in injection rate.

In FIG. 3, the injection command signal is turned on at a timing t1. The fuel injector 30 is energized and the needle valve 32 is opened, so that the fuel injection is started. At a timing t2, the injection rate starts increasing with the start of fuel injection. When the pressure propagation delay time has elapsed at a timing t3, the fuel pressure starts decreasing as the fuel pressure waveform. After the fuel pressure becomes a minimum value, the fuel pressure becomes substantially constant. When the fuel injection command signal is turned off at the timing t4, the needle valve 32 is closed so that the injection rate decreases. At a timing t5, the fuel injection is terminated so that the injection rate becomes zero. The fuel pressure increases to a maximum value and then decreases.

A fuel injection end timing Tend can be calculated based on the fuel pressure waveform. When the fuel pressure becomes a specified value after the injection command signal is tuned off, the fuel injection end timing Tend may be established.

However, when the fuel injection is stated, a pressure wave occurs in the high pressure passage 34. The fuel pressure level is fluctuated due to the pressure wave. In a case that the fuel injection end timing Tend is calculated based on the fuel pressure time-series data, the fuel injection end timing Tend may be dispersed. It is also conceivable that an inner diameter of the orifice 25 provided to the pipe connecting portion 22 may vary due to manufacturing variations. Therefore, a calculation accuracy of the injection end timing Tend may be deteriorated due to variation in orifice diameter.

According to the present embodiment, the fuel pressure Pf detected by the fuel pressure sensor 40 is differentiated to obtain a fuel pressure differential value dP. Based on the fuel pressure differential value dP, the fuel injection end timing Tend is calculated. When the fuel injection is terminated, an inclination of the fuel pressure waveform is varied. The variation in the inclination can be obtained by the fuel pressure differential value dP. Thus, the fuel injection end timing Tend can be appropriately obtained. In the present embodiment, the ECU 50 corresponds to a fuel pressure obtaining portion, a differential value calculating portion, and an end timing calculating portion.

Referring to FIG. 3, when the fuel pressure Pf varies in response to the injection command signal, the fuel pressure differential value dP is sequentially calculated. Then, the injection end timing Tend is calculated based on the timing t6 at which the fuel pressure differential value dP becomes the local maximum value (differential maximum value dP_max). The injection end timing Tend may be calculated by subtracting the pressure propagation time from the timing t6. The fuel pressure differential value dP depends on a variation in inclination of the fuel pressure waveform, but does not depend on the magnitude of the fuel pressure Pf. Thus, the injection ending time Tend can be appropriately obtained.

Also, after the injection command signal is turned off, the fuel pressure Pf rises. However, it is considered that the fuel pressure Pf repeatedly increases and decreases after reaching the maximum value once. That is, as the fuel pressure Pf repeatedly increases and decreases, a plurality of differential maximum values dP_max appear. In this case, it is necessary to correctly grasp the injection termination timing Tend from among the plurality of local maxima. The differential maximum value dP_max becomes largest at the first amplitude after the injection command signal is turned off, and then gradually attenuates.

According to the present embodiment, a period until the fuel pressure Pf reaches the injection start fuel pressure P1 after the injection command signal is turned off is determined as the maximum value detection period TA. The differential maximum value dP_max is detected in the maximum value detection period TA. Further, after the injection command signal is turned off, when the fuel pressure differential value dP is greater than a threshold dP_th, the differential maximum value dP_max is detected.

Figure 4:
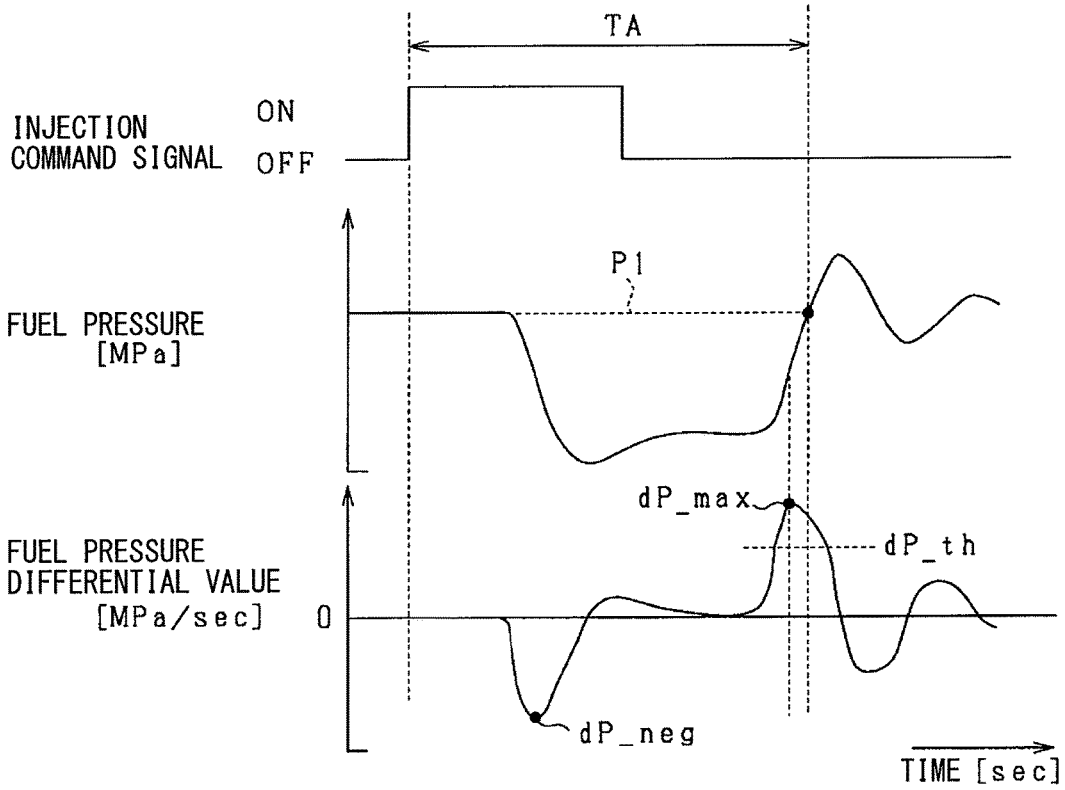
FIG. 4 is a time chart showing a maximum value detection period TA, a differential maximum value dP_max, and a threshold dP_th.

FIG. 4 is a time chart showing the maximum value detection period TA, the differential maximum value dP_max, and the threshold dP_th. The maximum value detection period TA is defined as a period from when the injection command signal is turned on until when the fuel pressure Pf reaches the injection start fuel pressure P1. In this period TA, the differential maximum value dP_max is detected. Under a condition where the fuel pressure differential value dP is greater than the threshold dP_th, the differential maximum value dP_max is detected. Then, the injection end timing Tend is calculated based on the differential maximum value dP_max.

The maximum value detection period TA may be a period from when the injection command signal is turned off until when the fuel pressure Pf reaches the injection start fuel pressure P1. In a broad sense, the maximum value detection period TA may be a period from when the injection command signal is turned off until when the fuel pressure Pf reaches a maximum value.

Figure 5:
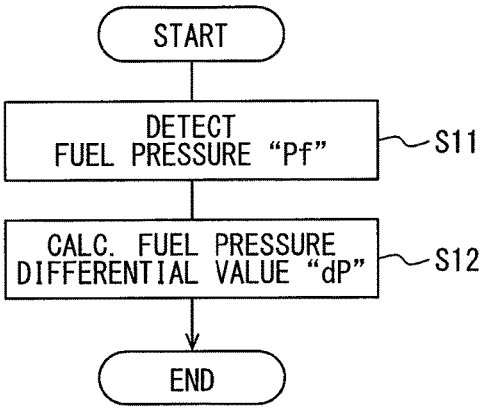
FIG. 5 is a flowchart showing a procedure for calculating a fuel pressure differential value.
Figure 6:
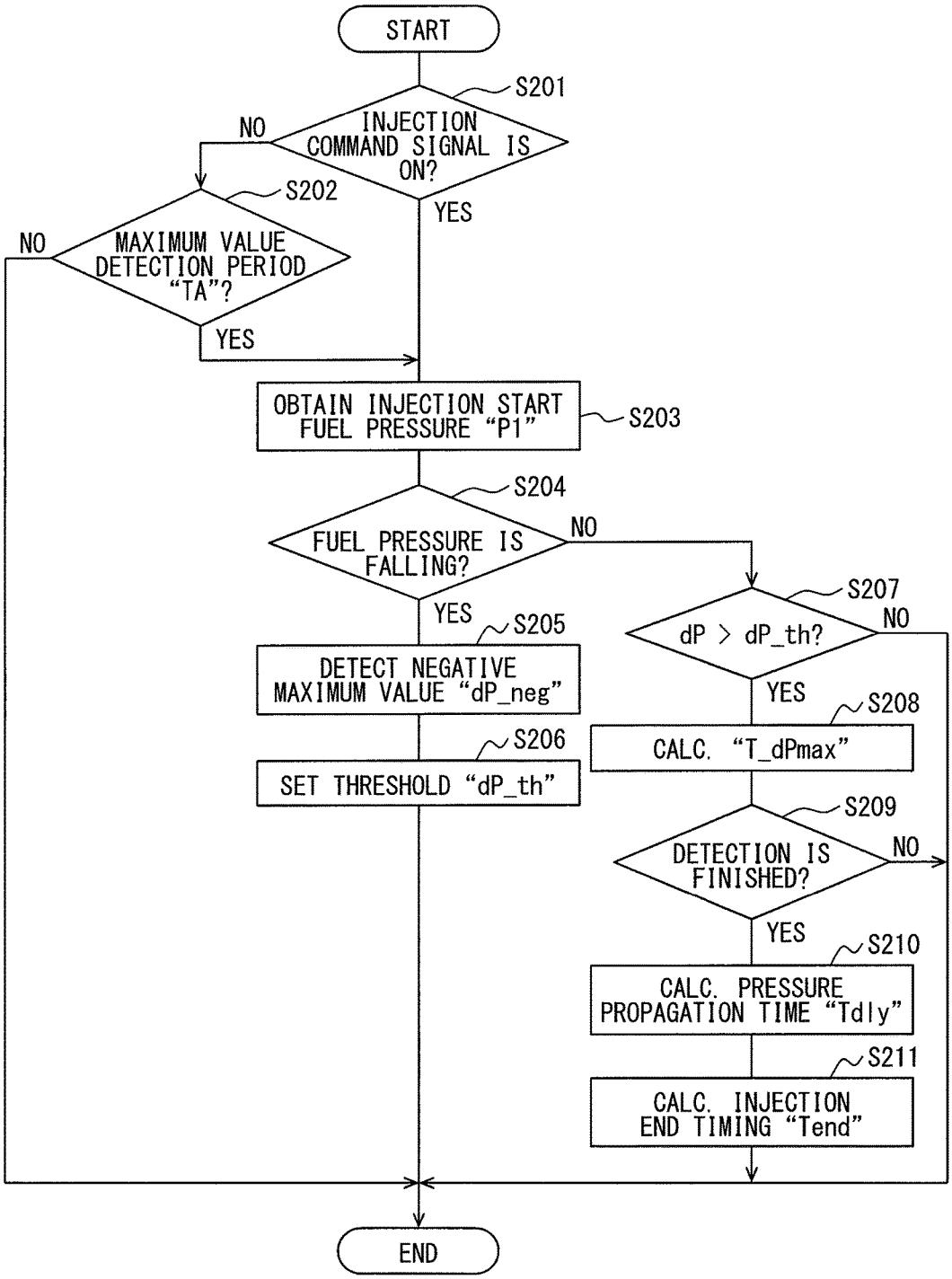
FIG. 6 is a flowchart showing a procedure for calculating an injection end timing.

Referring to flowcharts shown in FIGS. 5 and 6, an arithmetic processing performed by the ECU 50 will be described. FIG. 5 is a flowchart showing a processing procedure for calculating the fuel pressure differential value dP. FIG. 6 is a flowchart showing a processing procedure for calculating the injection end timing Tend based on the fuel pressure differential value dP.

In S11 of FIG. 5, a fuel pressure Pf is detected by the fuel pressure sensor 40. In S12, the fuel pressure differential value dP is calculated. For example, the fuel pressure differential value dP is calculated by subtracting a previous value of the fuel pressure Pf from a current value of the fuel pressure Pf.

In S201 of FIG. 6, it is determined whether the injection command signal is on. In S202, it is determined whether it is within the maximum value detection period TA. When the answer in S201 or S202 is YES, the procedure proceeds to S203. When the injection command signal is on, the answer in S201 is YES. In S203, the injection start fuel pressure P1 is obtained. In S204, it is determined whether it is in a fuel pressure falling time in which the fuel pressure falls along with an increase in fuel injection rate after the fuel injection is started. When the fuel pressure differential value dP is less than zero, it is determined that the fuel pressure is falling. When the answer is YES in S204, the procedure proceeds to S205. When the answer is NO in S204, the procedure proceeds to S207.

In S205, a negative maximum value dP_neg is detected, which is a negative maximum value of the fuel pressure differential value dP. The previous value of the fuel pressure differential value dP is compared with the current value. When the current value is larger than the previous value, the previous value is set as the negative maximum value dP_neg. The negative maximum value dP_neg is shown in FIG. 4.

Figure 7:
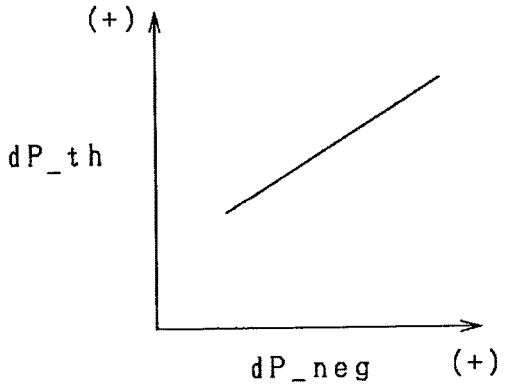
FIG. 7 is a chart showing a relationship between a negative maximum value dP_neg and a threshold dP_th.

In S206, the threshold dP_th is set. The threshold value dP_th is for detecting the differential maximum value dP_max. For example, the threshold value dP_th is defined based on a relationship shown in FIG. 7. FIG. 7 shows a relationship between the negative maximum value dP_neg and the threshold dP_th. As the negative maximum value dP_neg is larger, the threshold dP_th is set larger.

In S207, it is determined whether the fuel pressure differential value dP is larger than the threshold value dP_th. When dP >dP_th, the procedure proceeds to S208 in which a maximum value occurrence timing T_dPmax is calculated. At the maximum value occurrence timing T_dPmax, the differential maximum value dP_max occurs. At this time, the differential maximum value dP_max may be retrieved by successively comparing the previous value of the fuel pressure differential value dP and the current value.

It should be noted that a simple average or a weighted average may be calculated with respect to the time period during which the fuel pressure differential value dP is larger than the threshold value dP_th. Based on the average result, the maximum value occurrence timing T_dPmax may be calculated.

In S209, it is determined whether the maximum value detection period TA has elapsed. When the fuel pressure Pf rises to the injection start fuel pressure P1, it is determined that the maximum value detection period TA has elapsed. The procedure proceeds to S210.

Figure 8:
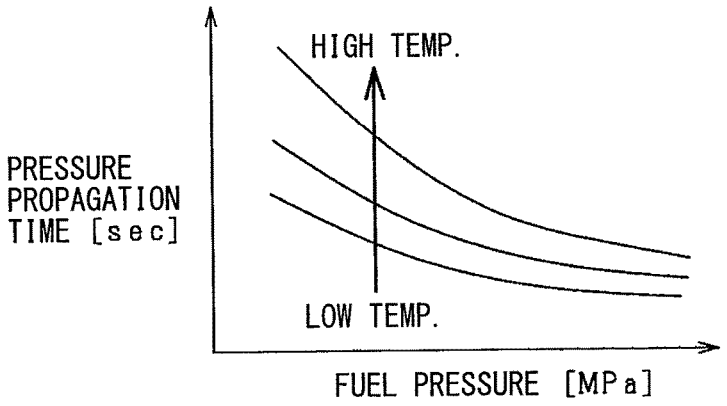
FIG. 8 is a diagram showing the relationship between fuel pressure, fuel temperature, and pressure propagation time.

In S210, the pressure propagation time Tdly is calculated. The pressure propagation time Tdly indicates a time period in which the pressure is propagated from the injection port 35 to the fuel pressure sensor 40. For example, the pressure propagation time Tdly is calculated based on a relationship shown in FIG. 8. FIG. 8 shows a relationship between the fuel pressure Pf and the pressure propagation time Tdly with respect to the fuel temperature. As the fuel pressure Pf is higher, the pressure propagation time Tdly is shorter. As the fuel temperature is higher, the pressure propagation time Tdly is longer. As the fuel pressure Pf, it is preferable to use the injection start fuel pressure P1. As a parameter indicating the fuel temperature, it is also possible to use the engine coolant temperature.

In S211, the injection end timing Tend is calculated based on the maximum value occurrence time T_dPmax and the pressure propagation time Tdly (Tend=T_dPmax−Tdly).

According to the present embodiment described above, the following effects can be obtained.

According to the present embodiment, the fuel pressure Pf detected by the fuel pressure sensor 40 is differentiated to obtain a fuel pressure differential value dP. Based on the fuel pressure differential value dP, the fuel injection end timing Tend is calculated. When the fuel injection is terminated, an inclination of the fuel pressure waveform is varied. The variation in the inclination can be obtained by the fuel pressure differential value dP. The fuel pressure differential value dP depends on a variation in inclination of the fuel pressure waveform, but does not depend on the magnitude of the fuel pressure Pf. Thus, the injection ending time Tend can be appropriately obtained even if manufacturing tolerances are generated.

When the injection command signal is turned off, the fuel pressure Pf starts increasing. Then, the inclination of the pressure increase becomes smaller along with a fuel injection ending (injection port 35 is closed). In this case, based on the differential maximum value dP_max, a variation in fuel pressure Pf can be obtained. Thus, based on a timing at which the differential maximum value dP_max is obtained, the injection end timing Tend can be appropriately calculated.

After the injection command signal is turned off, the fuel pressure Pf increase. After the fuel pressure Pf reaches the maximum value, the fuel pressure Pf repeatedly increases and decreases. Therefore, a plurality of differential maximum values dP_max may appear. The differential maximum value dP_max becomes largest at the first amplitude after the injection command signal is turned off, and then gradually attenuates. The differential maximum value dP_max is detected in the maximum value detection period TA. Even if the fuel pressure Pf repeatedly increases and decreases after the fuel injection is terminated, the differential maximum value dP_max can be properly detected.

More specifically, the maximum value detection period TA is defined as a period until the fuel pressure Pf reaches the injection start fuel pressure P1 after the injection command signal is turned off. That is, when the fuel pressure Pf increases after the injection command signal is turned off, the fuel in the high pressure pipe 14 and the high pressure passage 34 is consumed by a fuel injection. It is considered that the fuel injection has been finished when the fuel pressure is lowered than the injection start fuel pressure. In view of the above, the differential maximum value dP_max is properly detected.

After the injection command signal is turned off, the fuel pressure differential value dP also increases and decreases according to the change in the fuel pressure Pf. Its amplitude gradually decreases. After the injection command signal is turned off, the differential maximum value dP_max is detected under a condition where the fuel pressure differential value dP is greater than the threshold dP_th. Even if the fuel pressure Pf repeatedly increases and decreases after the fuel injection is terminated, the differential maximum value dP_max can be properly detected.

The fuel pressure waveform (rising waveform) after the injection command signal is turned off varies in accordance with the behavior of the decreasing fuel pressure. For example, as the fuel pressure more decreases immediately after the injection command signal is turned on, the fuel pressure increases more steeply after the injection command signal is turned off. In view of this, the threshold dP_th is established based on the negative maximum value dP_neg. As a result, the differential maximum value dP_max can be properly detected.

The injection end timing Tend is calculated based on a timing at which the differential maximum value dP_max is obtained and the pressure propagation time Tdly. Thus, the injection end timing Tend can be obtained more properly.

Other Embodiments

The above embodiment may be modified as follows.

Figure 9:
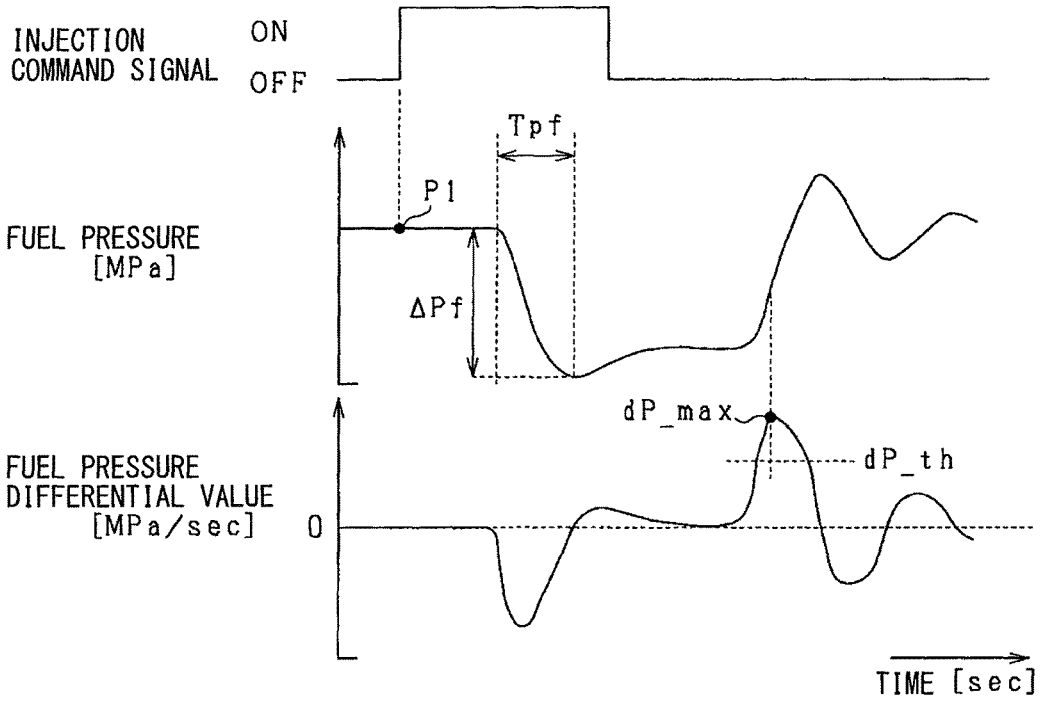
FIG. 9 is a time chart showing fuel pressure behaviors at a time of fuel injection by a fuel injector.
Figure 10A:
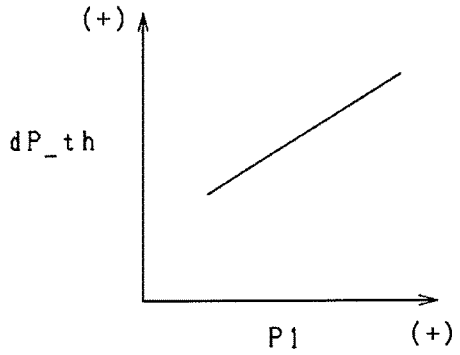
FIG. 10A is a chart showing a relationship between an injection start fuel pressure P1 and a threshold dP_th.
Figure 10B:
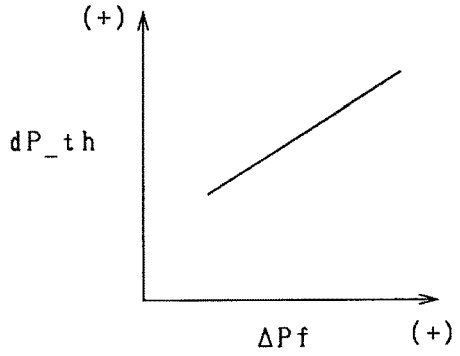
FIG. 10B is a chart showing a relationship between a fuel pressure decrease amount ΔPf and the threshold dP_th.
Figure 10C:
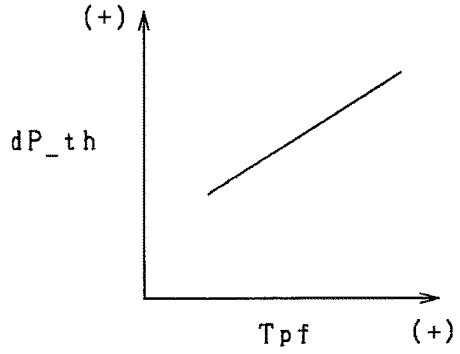
FIG. 10C is chart showing a relationship between the fuel pressure decrease time Tpf and the threshold dP_th.

In the above embodiment, the threshold dP_th is established according to the negative maximum value dP_neg. However, the threshold dp_th may be established based on a fuel pressure parameter other than the negative maximum value dP_neg. As shown in FIG. 9, the fuel pressure parameter includes any one of the injection start fuel pressure P1, a fuel pressure decrease amount ΔPf, and a fuel pressure decrease time Tpf. FIG. 10A shows a relationship between the injection start fuel pressure P1 and the threshold dP_th. FIG. 10B shows a relationship between the fuel pressure decrease amount ΔPf and the threshold dP_th. FIG. 100 shows a relationship between the fuel pressure decrease time Tpf and the threshold dP_th. According to the above, the differential maximum value dP_max can be appropriately detected.

The differential maximum value dP_max may be detected under a condition where it is in the maximum value detection period TA. Alternatively, the differential maximum value dP_max may be detected under a condition where the fuel pressure differential value dP is greater than the threshold dP_th.

In a case where a plurality of differential maximum values dP_max exist after the injection command signal is turned off, the injection end timing Tend may be calculated based on the largest local maximum value. Specifically, the ECU 50 calculates the injection end timing Tend according to the procedure shown in FIG. 11.

Figure 11:
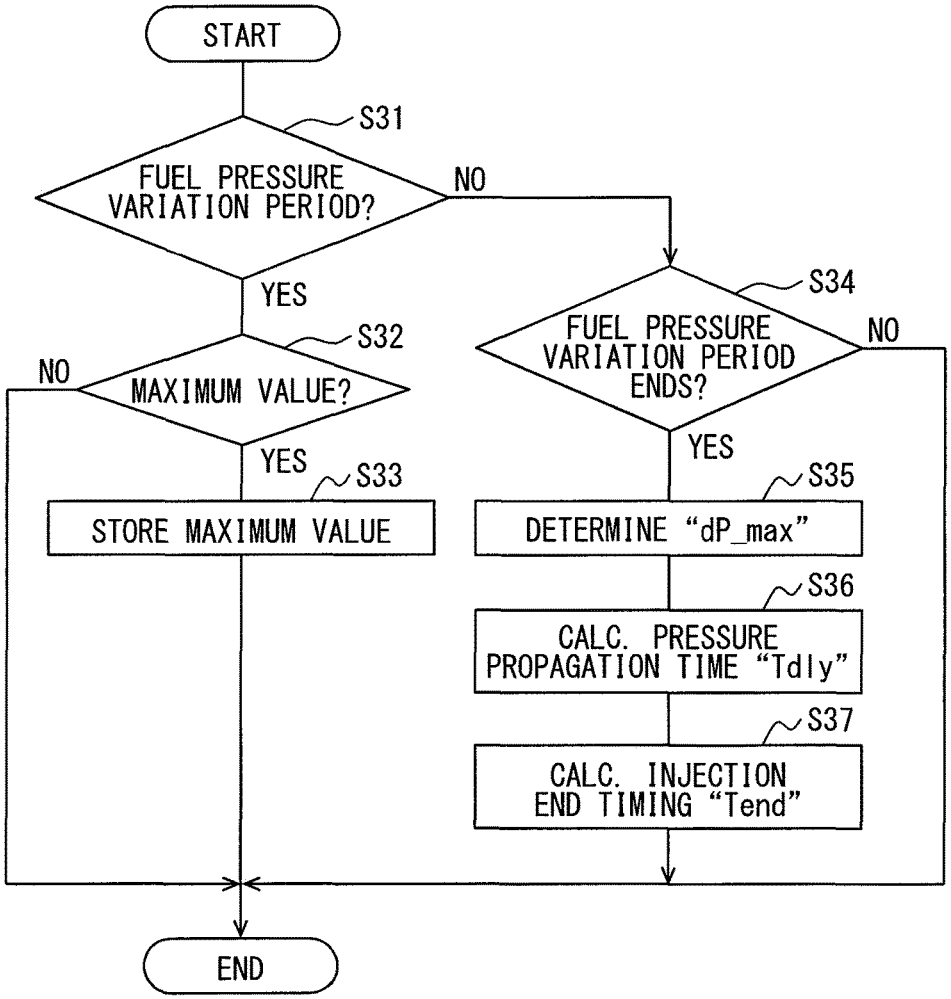
FIG. 11 is a flowchart showing a procedure for calculating an injection end timing.

In S31 of FIG. 11, it is determined whether it is in a fuel pressure variation period after the injection command signal is turned off. The fuel pressure variation period may be a predetermined period as long as the fuel pressure variation can be monitored. The maximum value detection period TA may be set as the fuel pressure variation period. When the answer is YES in S31, the procedure proceeds to S32 in which it is determined whether the fuel pressure differential value dP is the maximum value. When the answer is YES in S32, the procedure proceeds to S33 in which the current maximum value and the time are stored in a memory. The procedures in S32 and S33 are repeatedly executed during the fuel pressure variation period. It is also possible that the current maximum value and the time are stored in the memory as long as the fuel pressure differential value dP is larger than the threshold dP_th (dP>dP_th).

When the answer is NO in S31, the procedure proceeds to S34 in which it is determined whether it is an end of the fuel pressure variation period. When the answer is YES in S34, the procedure proceeds to S35 in which the differential maximum value dP_max is determined. In S36, the pressure propagation time Tdly is computed. In S37, the injection end timing Tend is calculated based T_dPmax and Tdly. According to the above configuration, even if the fuel pressure Pf repeatedly increases and decreases after the fuel injection is terminated, the differential maximum value dP_max can be properly detected.

The fuel pressure sensor 40 may be disposed in the body 31 of the fuel injector 30, the high pressure pipe 14, or the pipe connecting portion 22.

The present disclosure can be applied to a fuel injection system for a gasoline engine.

What is claimed is:

1. A fuel injection control device applied to a fuel injection system which includes a pressure accumulator accumulating a high pressure fuel, a fuel pump supplying the high pressure fuel to the pressure accumulator, a fuel injector injecting the high pressure fuel, and a fuel pressure sensor detecting a fuel pressure in a fuel passage between the pressure accumulator and an injection port of the fuel injector, the fuel injection control device comprising:

a fuel pressure obtaining portion which obtains the fuel pressure detected by the fuel pressure sensor;

a differential value calculating portion which differentiates the fuel pressure obtained by the fuel pressure obtaining portion so as to calculate a fuel pressure differential value; and an end timing calculating portion which calculates an injection end timing at which the fuel injector terminates a fuel injection.

2. The fuel injection control device according to claim 1, wherein the end timing calculating portion calculates the injection end timing based on a timing at which the fuel pressure differential value is maximum while the fuel pressure increases along with an injection command signal which is turned off.

3. The fuel injection control device according to claim 2, wherein a period after the fuel pressure starts increasing until the fuel pressure reaches a maximum value is defined as a maximum value detection period, and the end timing calculating portion detects the maximum value of the fuel pressure differential value in the maximum value detection period so as to calculate the injection end timing.

4. The fuel injection control device according to claim 3, wherein the maximum value detection period is a period from when the injection command signal is turned off until when the fuel pressure reaches an injection start fuel pressure.

5. The fuel injection control device according to claim 2, wherein the end timing calculating portion calculates the injection end timing under a condition where the fuel pressure differential value is greater than a threshold after the injection command signal is turned off.

6. The fuel injection control device according to claim 5, wherein the threshold is established based on any one of a maximum value of the fuel pressure differential value after the injection command signal is turned on, a fuel pressure decrease amount after the injection command signal is turned on, and a fuel pressure decrease time after the injection command signal is turned on.

7. The fuel injection control device according to claim 5, wherein the threshold is established based on an injection start fuel pressure.

8. The fuel injection control device according to claim 2, wherein the end timing calculating portion calculates the injection end timing based on a largest maximum value in a case where multiple maximum values of the fuel pressure differential value exist.

9. The fuel injection control device according to claim 2, further comprising a pressure propagation computing portion which calculates a pressure propagation time in which a pressure is propagated from the injection port to the fuel pressure sensor, wherein the end timing calculating portion calculates the injection end timing based on the pressure propagation time and a timing at which the fuel pressure differential value becomes maximum.

* * * * *